US010087650B1

(12) United States Patent
Hobbs

(10) Patent No.: US 10,087,650 B1
(45) Date of Patent: Oct. 2, 2018

(54) SHELTERED BLANKET SYSTEM

(71) Applicant: Ron Hobbs, Fort Worth, TX (US)

(72) Inventor: Ron Hobbs, Fort Worth, TX (US)

( * ) Notice: Subject to any disclaimer, the term of this patent is extended or adjusted under 35 U.S.C. 154(b) by 13 days.

(21) Appl. No.: 15/591,843

(22) Filed: May 10, 2017

Related U.S. Application Data

(60) Provisional application No. 62/334,183, filed on May 10, 2016.

(51) Int. Cl.

| | |
|---|---|
| ***E04H 15/30*** | (2006.01) |
| ***A47G 9/02*** | (2006.01) |
| ***E04H 15/02*** | (2006.01) |
| ***E04H 15/44*** | (2006.01) |
| ***E04H 15/56*** | (2006.01) |
| ***E04H 15/64*** | (2006.01) |

(52) U.S. Cl.
CPC ..... *E04H 15/30* (2013.01); *A47G 9/0223* (2013.01); *E04H 15/02* (2013.01); *E04H 15/44* (2013.01); *E04H 15/56* (2013.01); *E04H 15/64* (2013.01)

(58) Field of Classification Search
CPC ..... E04H 15/02; E04H 15/36; E04H 15/44; E04H 15/64; E04H 15/30; E04H 15/56; A47G 9/086; A47G 9/0223; A47G 9/1045
USPC ... 135/95, 96, 124, 136, 137, 116, 148, 119; 5/414, 415, 417–418
See application file for complete search history.

(56) References Cited

U.S. PATENT DOCUMENTS

| | | | | |
|---|---|---|---|---|
| 4,605,029 | A * | 8/1986 | Russell | E04H 15/324 135/125 |
| 5,059,463 | A * | 10/1991 | Peters | A47G 9/06 135/116 |
| 5,217,034 | A * | 6/1993 | Yih | A45F 4/14 135/90 |
| 6,192,909 | B1 * | 2/2001 | Strausser | E04H 15/40 135/116 |
| 6,216,716 | B1 * | 4/2001 | Gobel | A45F 3/52 135/126 |
| 7,698,756 | B1 * | 4/2010 | Chen | A47C 17/72 135/96 |
| 2003/0106578 | A1 * | 6/2003 | Cornist | E04H 15/324 135/137 |
| 2007/0272289 | A1 * | 11/2007 | Cooper | E04H 15/56 135/116 |
| 2008/0216881 | A1 * | 9/2008 | Ganz | E04H 15/36 135/96 |
| 2008/0223425 | A1 * | 9/2008 | Shumate | E04H 15/62 135/116 |
| 2010/0154852 | A1 * | 6/2010 | Trieu | A47C 17/64 135/96 |
| 2013/0074894 | A1 * | 3/2013 | Cook | E04H 15/54 135/96 |

* cited by examiner

*Primary Examiner* — Winnie S Yip
(74) *Attorney, Agent, or Firm* — Eldredge Law Firm; Richard G. Eldredge

(57) ABSTRACT

A system includes a blanket having a top surface; a plurality of attachment devices secured to the top surface; and a storage device secured to the top surface. The system further includes a collapsible shelter configured to fold and fit within the storage device, the collapsible shelter forming an inner cavity and having a bottom surface; and a plurality of fasteners secured to the bottom surface of the collapsible shelter. The plurality of fasteners are spaced apart from each other and configured to removably engage with the plurality of attachment devices.

1 Claim, 6 Drawing Sheets

SHELTERED BLANKET SYSTEM

BACKGROUND

Field of the Invention

The present invention relates generally to blanket systems, and more specifically, to a sheltered blanket system.

Description of Related Art

Blanket systems are well known in the art and are effective means to provide warmth to a user. For example, FIG. 1 depicts a conventional blanket system 101 having a user 103 and a sleeping bag 105.

One of the problems commonly associated with system 101 is its limited use. For example, the sleeping bag does not provide the user with privacy or protection from the elements.

Accordingly, although great strides have been made in the area of blanket systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
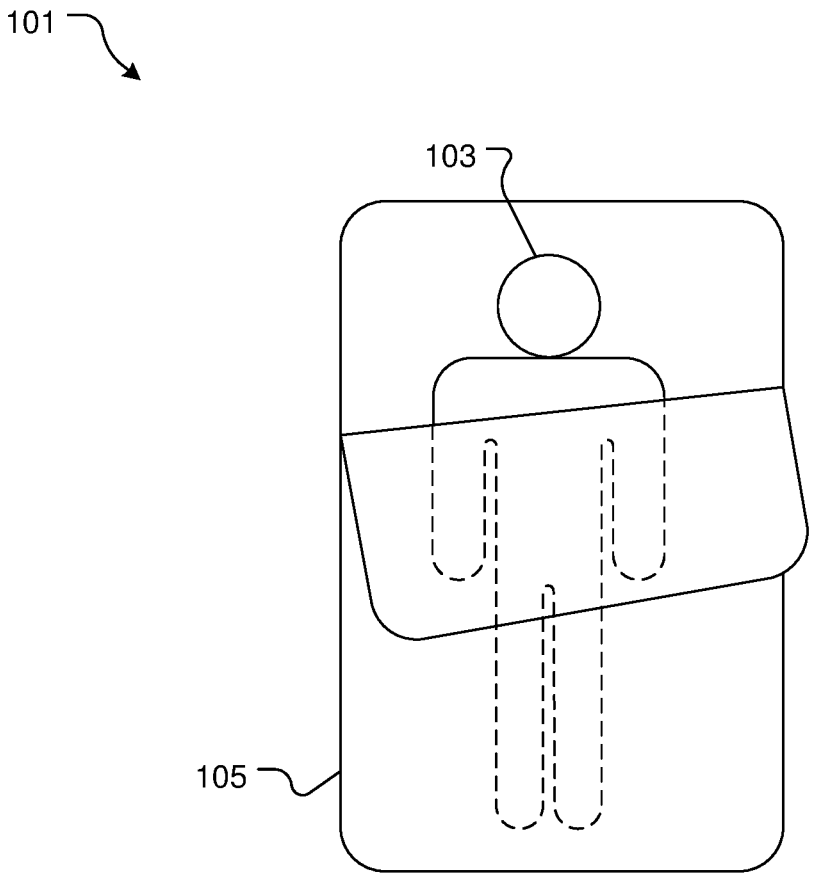
FIG. 1 (Prior Art)
FIG. 1 is a front view of a common blanket system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional blanket systems. Specifically, the system of the present application provides the user with both privacy and shelter. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
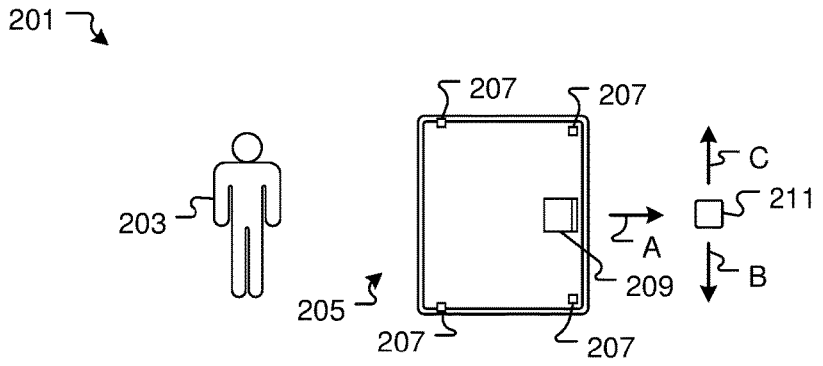
FIGS. 2A, 2B and 2C are top views of a sheltered blanket system in accordance with a preferred embodiment of the present application.
Figure 2B:
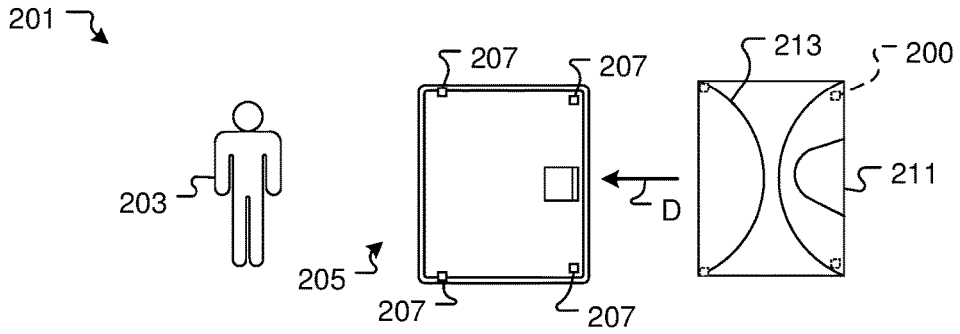
Figure 2C:
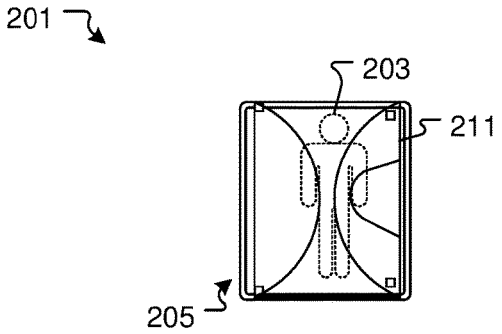

Referring now to the drawings wherein like reference characters identify corresponding or similar elements throughout the several views, FIGS. 2A, 2B and 2C depict top views of a sheltered blanket system in accordance with a preferred embodiment of the present application. It will be appreciated that system 201 overcomes one or more of the above-listed problems commonly associated with conventional blanket systems.

In the contemplated embodiment, system 201 comprises one or more users 203 and a blanket 205, the blanket 205 comprising one or more attachment devices 207 and in secure communication with one or more storage devices 209, wherein the storage device 209 encloses a collapsible shelter 211. In use, shelter 211 is removed from storage device 209 as shown by arrows A, B and C and secured to blanket 205 as depicted by arrow D via the attachment devices 207 such that the blanket becomes the floor to the shelter 211. In the preferred embodiment, a blanket 205 is utilized; however, it will be appreciated that other types of cushions, tarps, or similarly suitable coverings could be utilized in lieu of the preferred embodiment.

It should be appreciated that one of the unique features believed characteristic of the present application is that shelter 211 collapses and is stored with blanket 205 enabling the user 203 to conveniently transport the blanket 205 and shelter 211 together. It is also contemplated and will be appreciated that shelter 211 can incorporate a structural means 213 to provide a desired shape. The shelter 211 forms an inner cavity for receiving the user therein. Further, the shelter has a lower surface configured to rest on the top surface of the blanket and a plurality of fasteners 200 secured to the lower surface of the shelter 211 and configured to engage with the attachment devices secured to the top surface of the blanket 205, as depicted in FIGS. 2A, 2B, and 2C of the drawings. In one contemplated embodiment, the fasteners 200 and attachment devices 207 are hook-loop fasteners; however, alternative embodiments could include clip, snaps, magnets and/or other quick-release devices in lieu of the preferred embodiment.

Figure 3:
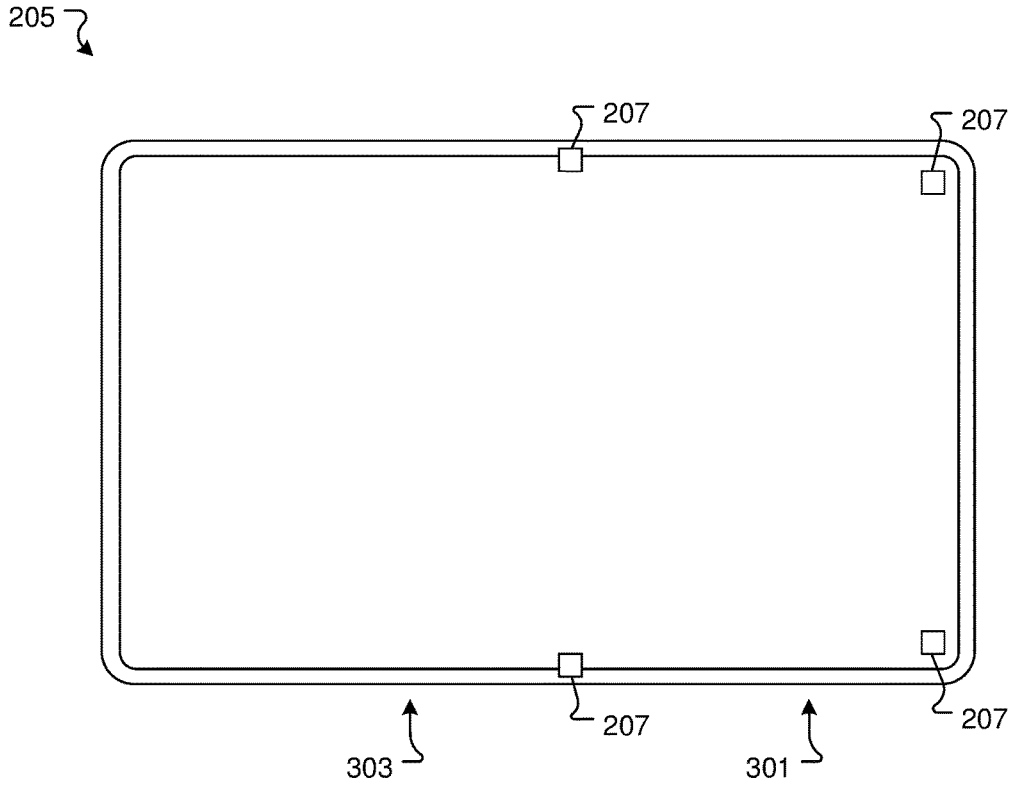
FIG. 3 is a top view of the blanket and attachment devices of FIGS. 2A, 2B and 2C.

Referring now to FIG. 3 an alternative embodiment of blanket 205 is shown, the blanket 205 comprising one or more attachments means 207 generally positioned on a first side 301 of the blanket 205 and absent from the second side 303 of the blanket 205, such that the first side 301 can be used as the base for shelter 207 (see FIG. 2) and the second side 303 can be retained for use as a blanket.

Figure 4:
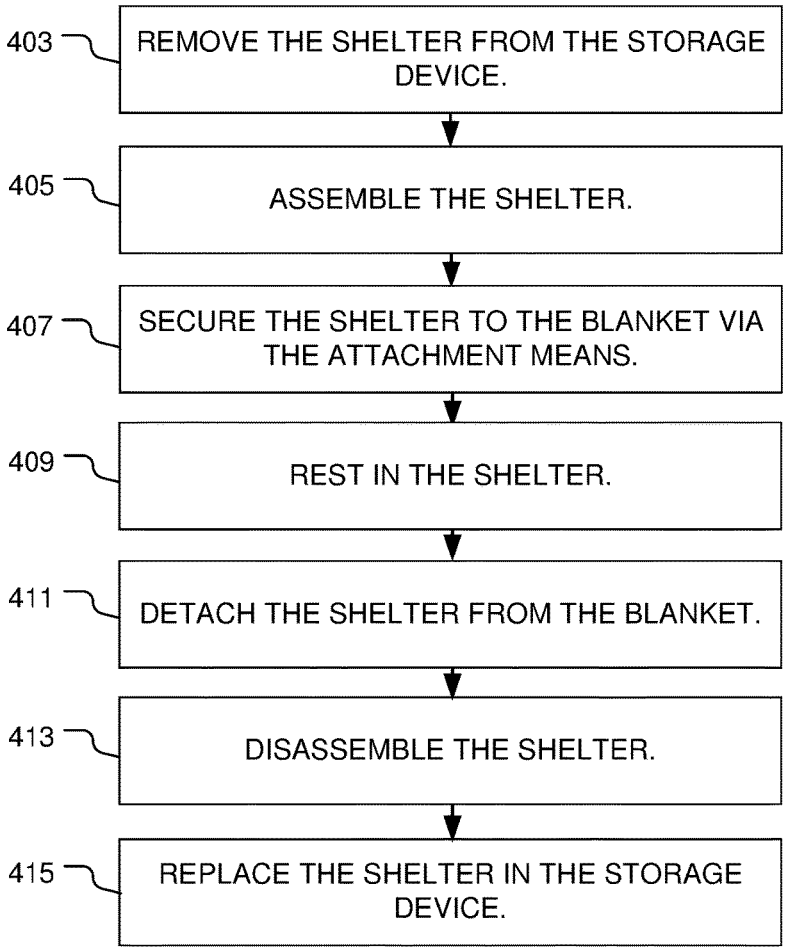
FIG. 4 depicts a method of use of the system of FIGS. 2A, 2B and 2C.

Referring now to FIG. 4 the method of use of system 201 is depicted, the method 401 comprising removing the shelter from the storage device 403, assembling the shelter 405, securing the shelter to the blanket via the attachment devices 407, resting in the shelter 409, detaching the shelter from the blanket 411, disassembling the shelter 413 and replacing the shelter in the storage device 415.

Figure 5A:
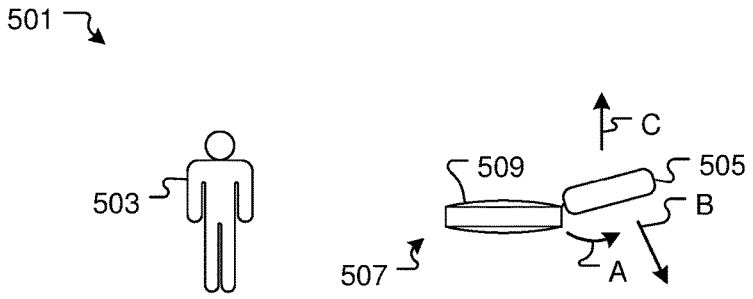
FIGS. 5A, 5B, and 5C is a side view of an alternative embodiment of the system of FIGS. 2A, 2B and 2C.
Figure 5B:
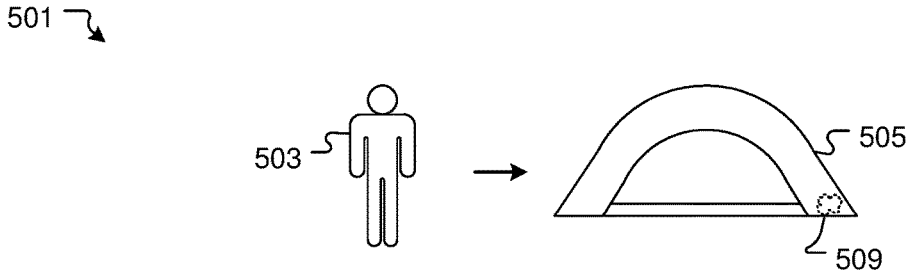
Figure 5C:
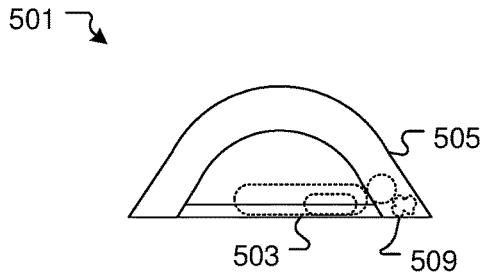

Referring now to FIGS. 5A, 5B and 5C an alternative embodiment of system 201 is depicted, the embodiment 501 comprising one or more users 503 and one or more pillows 507 in secure communication with one or more storage devices 509, wherein storage device 509 encloses a collapsible shelter 505. In use the shelter 505 is removed from the storage device 509 as depicted by motion A, assembled as shown by motions B and C.

Figure 6:
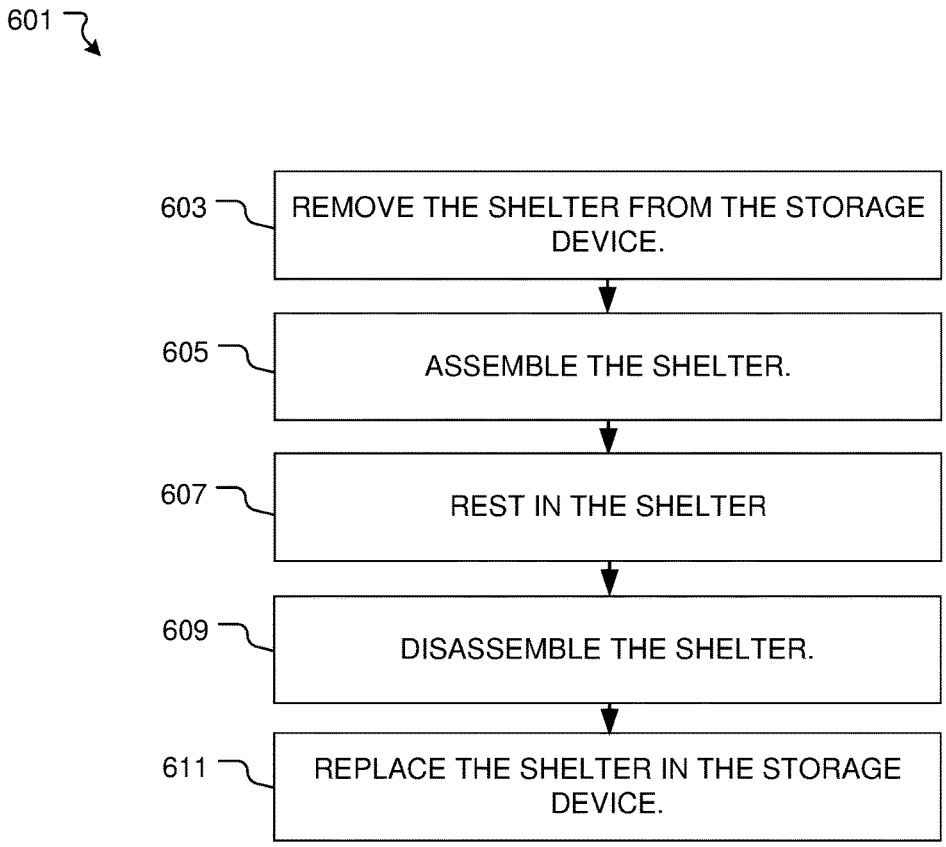
FIG. 6 depicts a method of use of the system of FIG. 5.

Referring now to FIG. 6 the method of use of system 501 is depicted, the method 601 comprising removing the shelter from the storage device 603, assembling the shelter 605, resting in the shelter 607, disassembling the shelter 609 and replacing the shelter in the storage device 611.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system, comprising:

a blanket having:

a top surface;

a plurality of attachment devices secured to the top surface; and a storage device secured to the top surface;

a collapsible shelter configured to fold and fit within the storage device, the collapsible shelter forming an inner cavity, the collapsible shelter is removably attached to the top surface of the blanket and having:

a canopy having bottom surface, the canopy forming an opening; and a plurality of fasteners secured to the bottom surface of the collapsible shelter;

wherein the plurality of fasteners are spaced apart from each other and configured to removably engage with the plurality of attachment devices;

wherein the blanket covers the opening of the canopy to form an enclosed area; and wherein the blanket and the collapsible shelter secure to each other solely via the plurality of attachment devices and the plurality of fasteners.

* * * * *